US006018842A

United States Patent [19]

Ayres

[11] Patent Number: 6,018,842

[45] Date of Patent: Feb. 1, 2000

[54] GLASS WASHING MACHINE

[75] Inventor: Tom Ayres, Harmony, Pa.

[73] Assignee: Billco Manufacturing, Inc., Zelienople, Pa.

[21] Appl. No.: 09/132,598

[22] Filed: Aug. 11, 1998

Related U.S. Application Data

[60] Provisional application No. 60/055,511, Aug. 13, 1997.

[51] Int. Cl.[7] ..... A47L 5/38; A47L 5/00; A47L 11/00; A47L 11/32; B08B 3/00

[52] U.S. Cl. ..... 15/316.1; 15/309.2; 15/40; 15/77; 134/71

[58] Field of Search ..... 134/71, 148, 151, 134/124, 131, 64 R, 122 R; 15/40, 77, 309.2, 316.1; 34/107; 181/225, 198; 415/119

[56] References Cited

U.S. PATENT DOCUMENTS

| | | | |
|---|---|---|---|
| 2,671,241 | 3/1954 | Starner | 15/361.1 |
| 3,266,074 | 8/1966 | Wehr | 15/77 |
| 3,449,781 | 6/1969 | French et al. | 15/77 |
| 3,780,826 | 12/1973 | Hubbell | 181/36 B |
| 3,805,317 | 4/1974 | Dickinson | 15/306 B |
| 3,886,959 | 6/1975 | Stott | 134/134 |
| 4,253,247 | 3/1981 | Bergstrom | 34/155 |
| 4,295,284 | 10/1981 | Witkin | 34/155 |
| 4,364,147 | 12/1982 | Biedermann et al. | 15/404 |
| 4,406,388 | 9/1983 | Takashi et al. | 226/7 |
| 4,544,395 | 10/1985 | Evans | 65/60.3 |
| 4,702,017 | 10/1987 | Lenhardt | 34/107 |
| 4,985,106 | 1/1991 | Nelson | 156/276 |
| 5,005,250 | 4/1991 | Trautmann et al. | 15/309.2 |
| 5,010,619 | 4/1991 | Lisec | 15/307 |
| 5,044,705 | 9/1991 | Nelson | 312/228 |
| 5,241,758 | 9/1993 | Cruz et al. | 34/22 |
| 5,259,124 | 11/1993 | Poterala | 34/155 |
| 5,303,484 | 4/1994 | Hagen et al. | 34/155 |
| 5,548,093 | 8/1996 | Sato et al. | 181/224 |
| 5,776,579 | 7/1998 | Jessup et al. | 428/73 |
| 5,801,344 | 9/1998 | Herold | 181/272 |

*Primary Examiner*—Frankie L. Stinson
*Assistant Examiner*—Paul Lee
*Attorney, Agent, or Firm*—Webb Zisenheim Logsdon Orkin & Hanson, P.C.

[57] ABSTRACT

A glass washing machine for washing and drying glass workpieces incorporates a variety of noise reduction features. These noise reduction features include the use of tight-fitting, sound-reducing panels, a separate blower in a substantially enclosed space, a greater spacing of a washing section from a drying section, isolation mounting of individual air knives, air supply to the individual air knives substantially along their length, concentric air supply pipes leading from the blower and lateral labyrinth type vents in the drying section.

13 Claims, 6 Drawing Sheets

GLASS WASHING MACHINE

The present application claims the benefit of Unites States Provisional Patent Application Serial No. 60/055,511 filed on Aug. 13, 1997 entitled "Glass Washing Machine" which is incorporated herein by reference.

BACKGROUND OF THE INVENTION

1. Field of the Invention

The present invention relates to class processing equipment. More specifically, the present invention relates to glass washing machines.

2. Background Information

Recently, noise reduction in manufacturing environments has become a significant concern. Continuous exposure to noise levels above 85 decibels can be damaging to the ears and presents a hazardous working environment.

In glass processing environments, existing glass washing machines have been found to be a significant source of noise. Glass washing machines are used for cleaning and drying of glass work products, typically in the form of flat panels. It is an object of the present invention to provide a glass washing machine which overcomes the noise issues associated with existing glass washing machines. Another object of the present invention is to provide a relatively quiet glass washing machine which does not significantly increase the size, cost or effective operation of the glass washing machine.

SUMMARY OF THE INVENTION

The objects of the present invention are achieved by the glass washing machine according to the present invention. The glass washing machine of the present invention operates essentially the same as existing glass washing machines. Glass panels to be cleaned are introduced along a chain-driven conveyor through a washing section which utilizes brushes and pressure sprays for cleaning the glass workpieces. The conveyor then transports the workpiece through a drying section which utilizes a plurality of air knives for drying the glass panel. The glass washing machine of the present invention differs in several important respects from conventional existing glass washing machines. These distinctions are designed to decrease the overall noise of the glass washing machine without significantly increasing the cost and size or significantly changing the operation of the machine. The first change is increasing the linear distance between the washing section and drying section that is found in conventional machines. A second aspect of the present invention is positioning of the blower in a separate, enclosed space with vibration damping mounting for the blower motor. A third important aspect of the present invention is the use of tight-fitting, sound-reducing panels substantially completely surrounding the washing and drying sections of the glass washing machine. The incorporation of tight-fitting panels additionally requires the design of venting for the drying section. The venting has been designed so as not to impede the driving operation. The venting is achieved by venting through lateral labyrinth type vents. This venting arrangement further provides that the vent does not significantly increase the noise emissions of the machine. Additionally, a double air hose is utilized for transporting air from the blower to the individual air knives. The air is supplied to the specific air knives substantially along the length of the air knives as opposed to from the end of the air knives as in the prior art. Finally, the individual air knives are provided with isolation mounting.

All of the above features of the glass washing machine of the present invention have been designed to reduce the noise of the glass washing machine without detrimentally effecting the other operative characteristics of the machine. These and other advantages of the glass washing machine of the present invention will be clarified in the Detailed Description of the Preferred Embodiments taken together with the attached figures wherein like reference numerals represent like elements throughout.

DETAILED DESCRIPTION OF THE PREFERRED EMBODIMENTS

Figure 1:
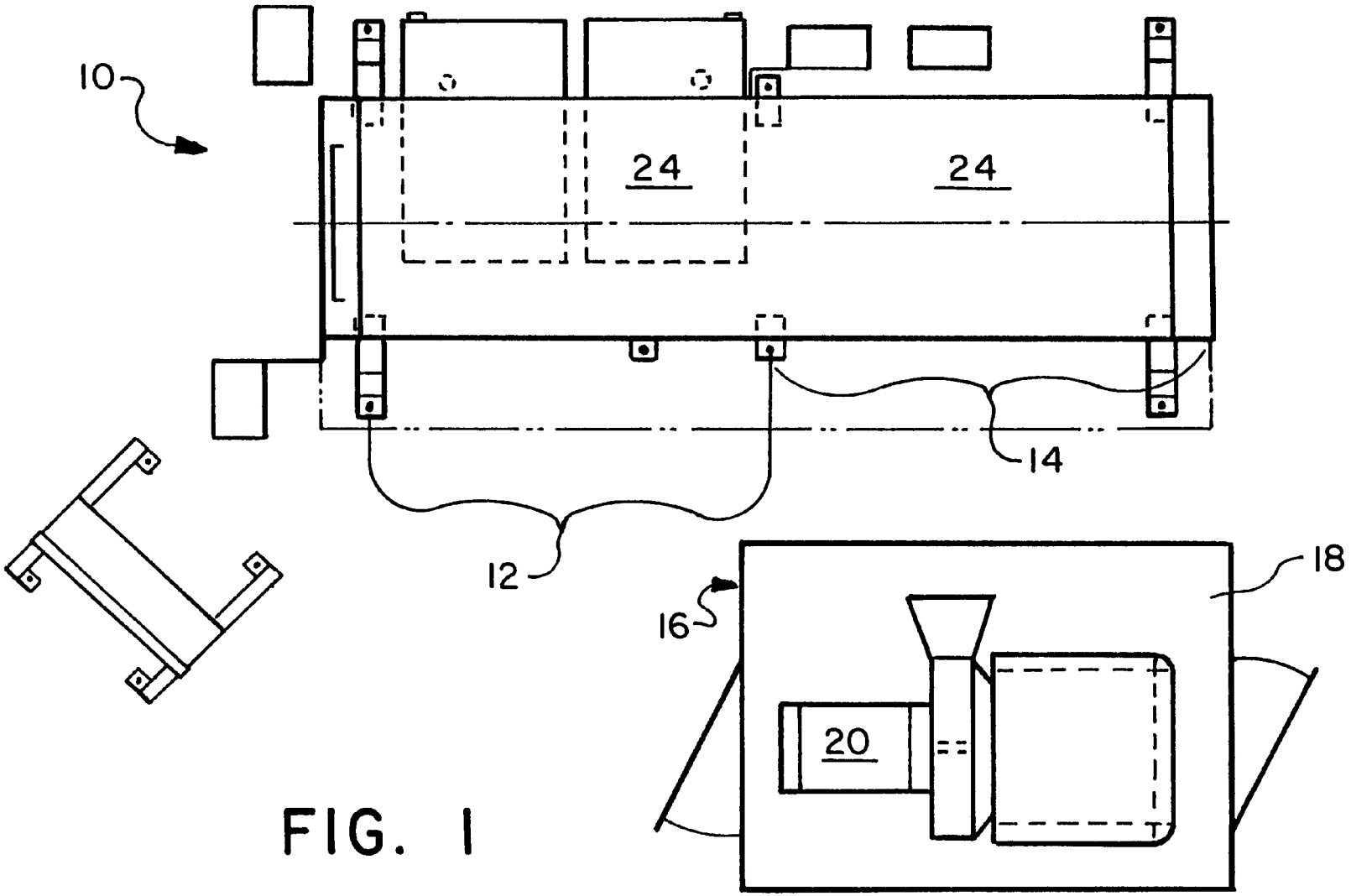
FIG. 1 is a plan view illustrating the general layout of the glass washing machine of the present invention.
Figure 2:
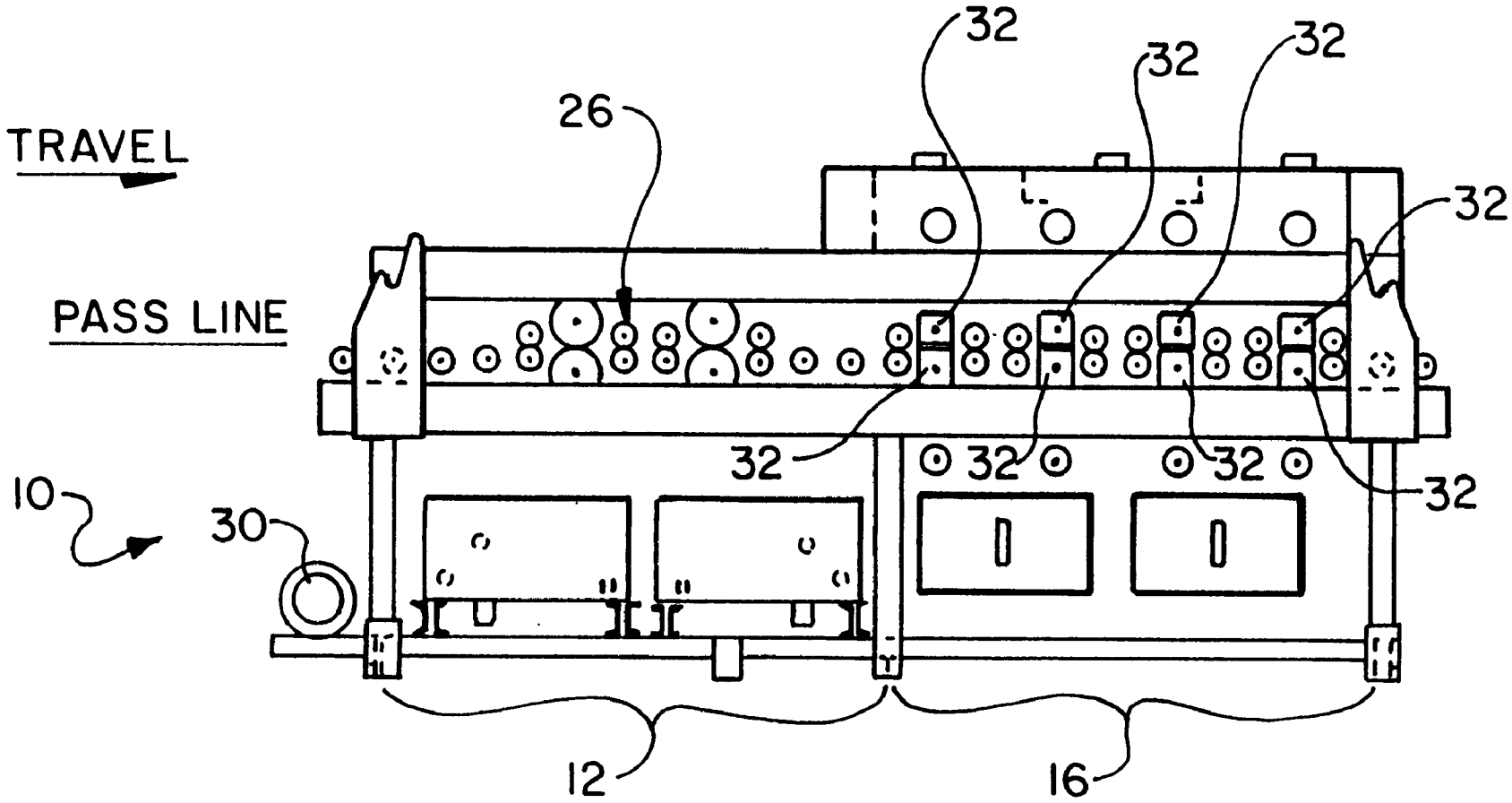
FIG. 2 is a side view of the glass washing machine illustrated in FIG. 1 with a blower unit removed.

FIGS. 1 and 2 illustrate the general layout of the glass washing machine 10 according to the present invention. The glass washing machine 10 includes a washing section 12 shown generally in FIG. 2 and a drying section 14 spaced longitudinally from the washing section 12, as illustrated in FIG. 2. The glass washing machine 10 additionally includes a blowing unit 16 for supplying air to the drying section 14.

Figure 3:
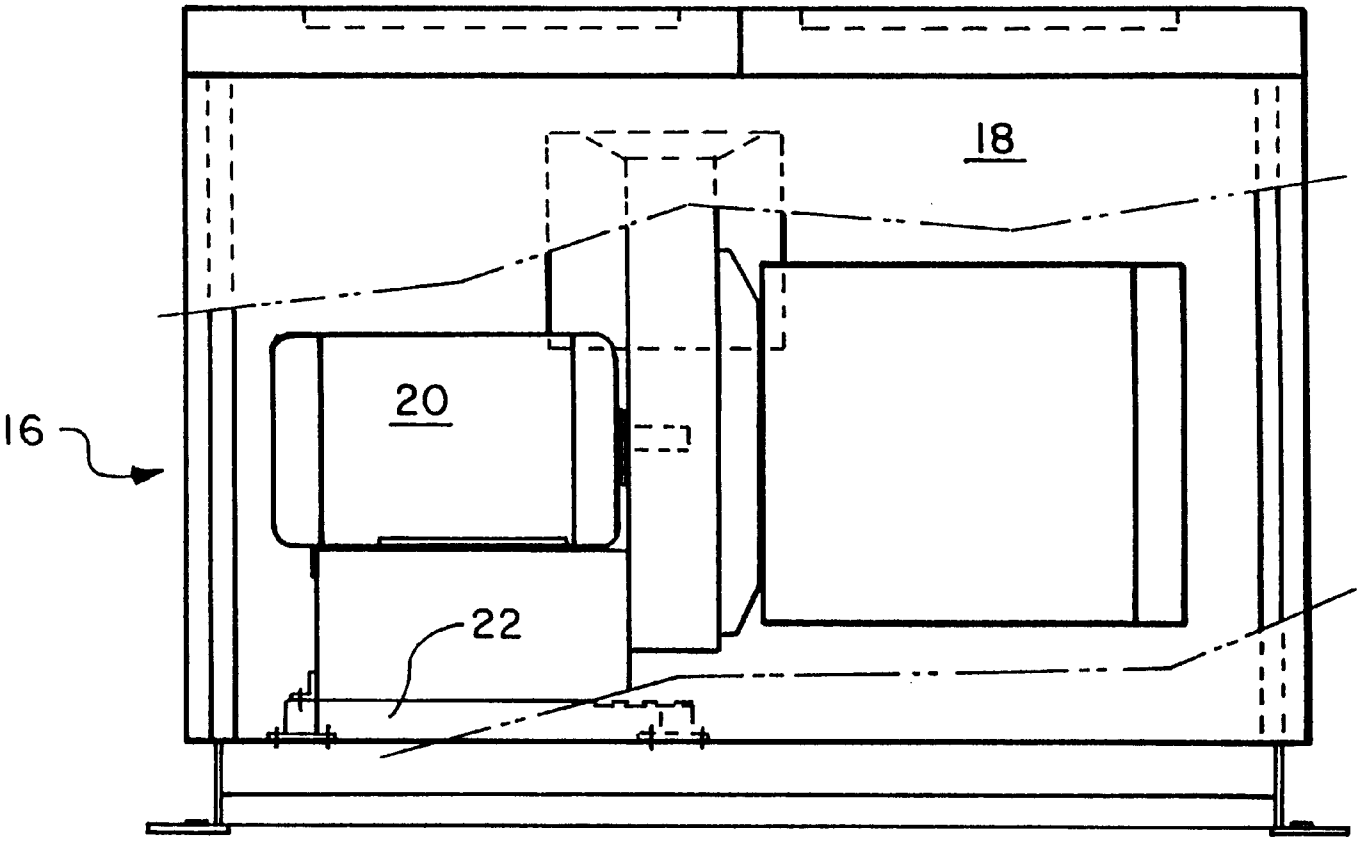
FIG. 3 is a side view of the blower unit of the glass washing machine illustrated in FIG. 1.
Figure 4:
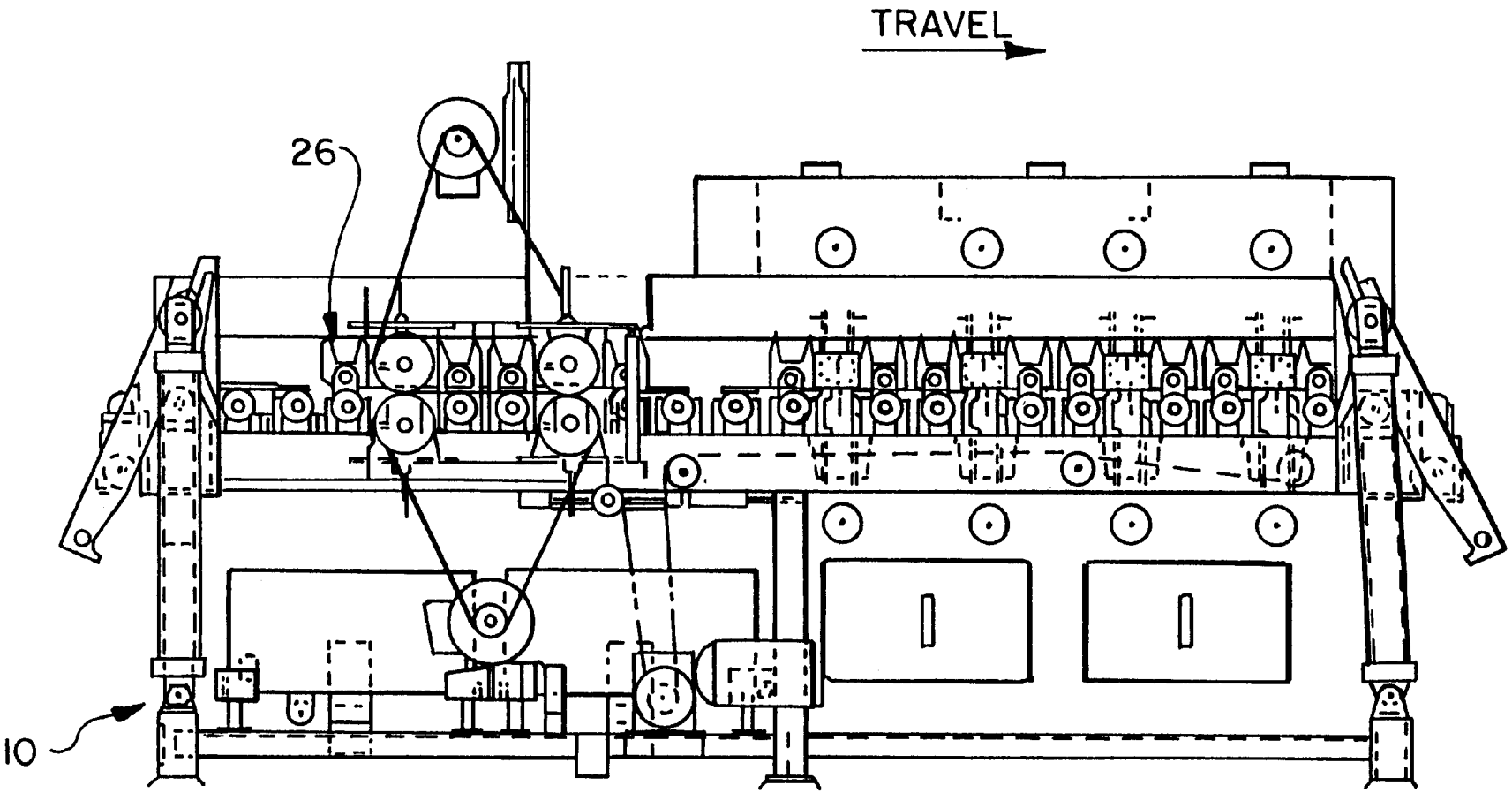
FIG. 4 is a side view, partially in cross-section, illustrating the general layout of the glass workpiece conveying assembly for the glass washing machine of the present invention.

The construction of the blowing unit 16 represents one of the important features used for reducing the noise of the glass washing machine 10 of the present invention relative to the glass washing machines known in the prior art. The blowing unit 16, as shown in FIGS. 1 and 3, is spaced from the remaining portions of the glass washing machine 10. The spacing of the blowing unit 16 from the remaining portions of the glass washing machine 10 allows the blowing unit 16 to be enclosed in a separate housing 18, as shown in FIG. 3. Additionally, the blower motor 20 of the blowing unit 16 is mounted on a vibration mount 22 which further reduces noise associated with the blowing unit 16. A second important feature of the glass washing machine 10 of the present invention is the use of tight-fitting, sound-reducing panels 24 substantially around the entire glass washing machine 10. The tight-fitting sound-reducing panels 24 are located around the sides, the top and even the bottom of the glass washing machine 10 to provide a substantially enclosed space.

The glass washing machine 10 transports flat glass panels through the washing section 12 and drying section 14 along a conveyor system 26 which is illustrated in detail in FIG. 3. The conveyor system 25 operates in a conventional fashion. The design of the glass washing machine 10 is specifically intended to not alter the conventional function and operation of the glass washing and drying units.

Figure 5:
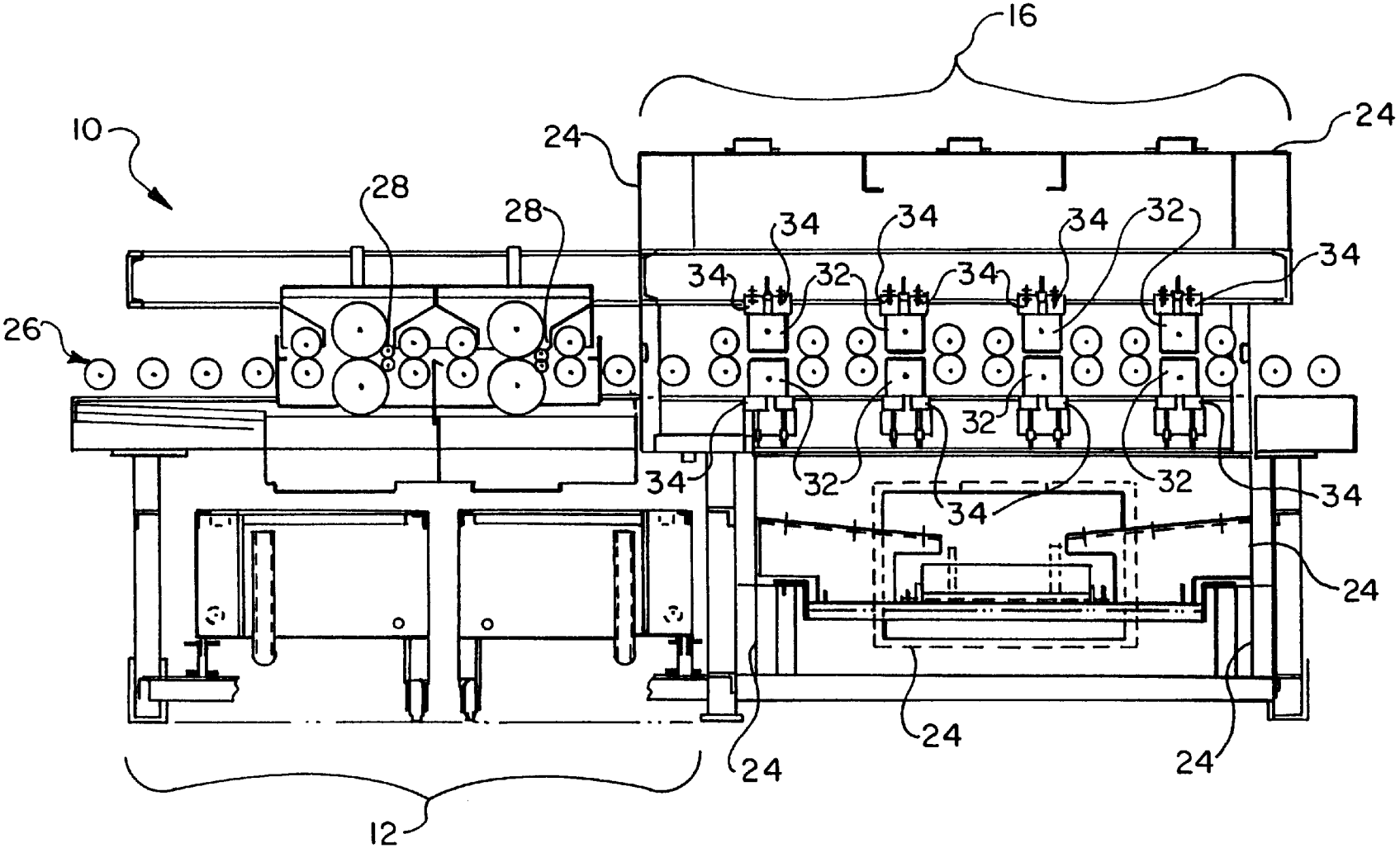
FIG. 5 is a longitudinal section of the glass washing machine illustrated in FIGS. 1–4.

As shown in FIG. 5, the washing section 12 utilizes a plurality of spray lines 28 on opposite sides of the pass line for cleaning each individual glass workpiece. Rotary brushes may also be used in the washing section 12. A pump 30, shown in FIG. 2, is utilized for supplying appropriate cleaning fluid to the individual spray lines 28 in a conventional fashion. The drying section 14 follows the washing section 12 and is spaced farther from the washing section 12 than in existing machine, as shown in FIG. 2. The spacing of the drying section 14 from the washing section 12 allows the glass washing machine 10 to further isolate and reduce excessive noise in the glass washing machine 10. The drying section 14 uses a plurality of air knives 32 on opposite sides of the pass line for the glass workpieces for drying each glass workpiece as it moves along the conveyor system 26. As shown in FIG. 5, sound reducing panels 24 completely enclose the drying section 14.

Figure 6:
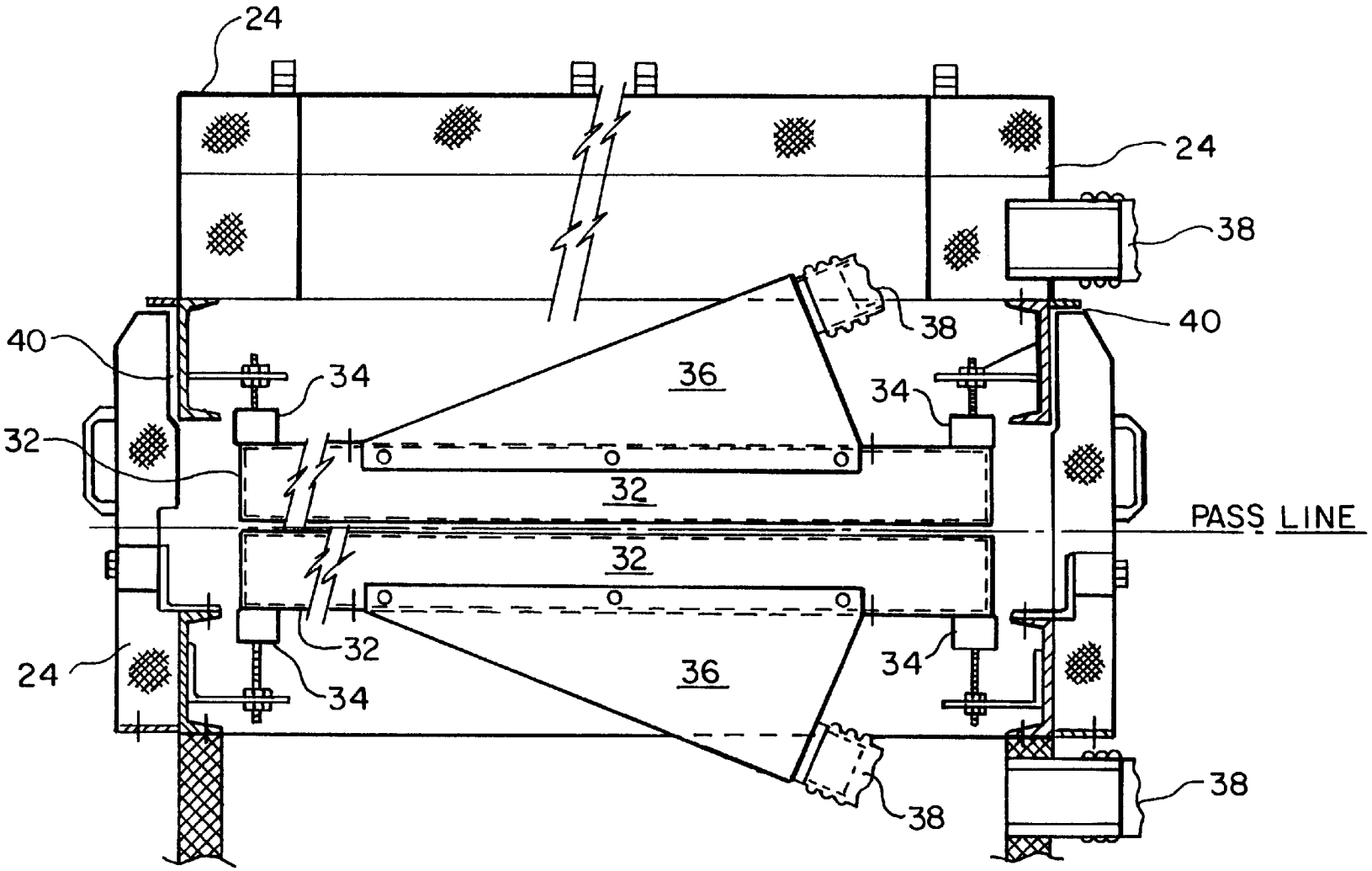
FIG. 6 is a cross-section of the glass washing machine in FIG. 5 illustrating the individual air knife assemblies.

FIG. 6 illustrates the details of the air knives 32 and the associated air supply system. Each individual air knife 32 is formed as a longitudinal flume or plenum which has a narrow slot facing the workpiece, as known in the art. Air is forced through the air knives 32 onto the workpiece to dry the workpiece. The present invention utilizes isolation mounting for the individual air knives 32 to further reduce the noise associated with the glass washing machine 10. The isolation mounting is comprised of rubber bumpers 34 positioned between each air knife 32 and the associated frame mounting, as shown in FIG. 6. Additionally, air is introduced into the air knives 32, generally in the middle of the air knives 32, substantially along the entire longitudinal length of the air knives 32 through air knife supply member 36, as shown in FIG. 6. The supply of the air along generally the entire length of the air knives 32 is a distinct advantage over forcing the air to proceed through one end of the air knife 32, as in the prior art. Double air hoses 38 are utilized for transporting the air from the blowing unit 16 to the air knives 32 through air knife supply member 36. A portion of the double air hoses 38 is illustrated in FIG. 6. The double air hoses 38 are formed of a pair of concentric, flexible tubes with the inner tube utilized for transporting the air and the spacing between the inner tube, and the outer tube utilized for sound deadening, thereby reducing the noise of the glass washing machine 10.

The present invention additionally provides for venting of the drying section 14 so as not to impede the drying of the glass workpieces by the air knives 32. The venting is accomplished through the side of the drying section 14 through labyrinth type vents 40, some of which are illustrated in FIG. 6. Designing the vents 40 so as not to disrupt the air flow or otherwise impede the drying characteristics of the air knives 32 reduces the amount of air necessary for drying and thereby reduces the noise associated with the glass washing machine. Additionally, the use of a labyrinth type venting arrangement will reduce the noise of the glass washing machine 10 of the present invention.

The glass washing machine 10 of the present invention operates in a conventional fashion, as described above. The glass washing machine 10 of the present invention incorporates seven distinct features which have been designed to reduce the noise of the glass washing machine 10 over existing glass washing machines without detrimentally effecting the size, cost or operation of the glass washing machine 10. These modifications include the use of tight-fitting panels 24 completely around the glass washing machine 10, increasing the space between the washing section 12 and drying section 14, utilizing a separate sound enclosure (housing 18) for the blowing unit 16, venting of the drying section 14 through lateral labyrinth seals, use of concentric air hoses (double air hose 38) for supplying air from the blower, supplying air along the length of the air knives 32 from air knife supply member 36, and isolation mounting of the individual air knives 32 with the rubber bumpers 34. All of these features combine to form the relatively quiet glass washing machine 10 of the present invention.

It will be apparent to those of ordinary skill in the art that various changes may be made to the present invention without departing from the spirit and scope thereof. This specific example is merely intended to be illustrative of the present invention and not restrictive thereof. Consequently, the scope of the present invention is defined by the claims and equivalents thereto.

I claim:

1. A glass washing machine comprising:

a washing section;

a drying section spaced from said washing section;

a conveyor for transporting glass workpieces through said washing section and said drying section;

means for cleaning the glass workpieces within said washing section;

means for drying said glass workpieces in said drying section; and a blower mounted on a base through vibration damping mounts in an enclosed housing which is spaced from said washing section and said drying section, said blower supplying a drying gas to said drying means within said drying section.

2. The glass washing machine of claim 1 further including sound reducing panels substantially completely surrounding said washing section and said drying section.

3. The glass washing machine of claim 2 wherein said sound reducing panels are tight fitting panels and further including vents in said drying section.

4. The glass washing machine of claim 3 wherein said vents are lateral labyrinth vents.

5. The glass washing machine of claim 1 wherein said drying means include a plurality of air knives directed at the glass workpieces, wherein said air knives include an extended flume and an air supply member coupled to said flume in the middle of said flume such that air is supplied to each said air knife substantially along the length of said air knife.

6. A glass washing machine comprising:

a washing section;

a drying section spaced from said washing section;

a conveyor for transporting glass workpieces through said washing section and said drying section;

means for cleaning the glass workpieces within said washing section;

means for drying said glass workpieces in said drying section;

a blower mounted in an enclosure spaced from said washing section and said drying section, said blower supplying a drying gas to said drying means within said drying section; and concentric hoses for transporting gas from said blower to said drying means.

7. A glass washing machine comprising:

a washing section for cleaning glass workpieces; and a drying section spaced linearly frog said washing section, said drying section for drying said glass workpieces, said drying section including a plurality of air knives directed toward the glass workpieces, wherein said air knives include an extended flume and an air supply member coupled to said flume in the middle of said flume such that air is supplied to specific air knives substantially along the length of the air knives, wherein said air knives are mounted on a housing with an isolation mount, said isolation mount including a rubber bumper positioned between each said air knife and a mounting frame member.

8. A glass washing machine comprising:

a washing section for cleaning glass workpieces;

a drying section spaced linearly from said washing section, said drying section for drying said glass workpieces, said drying section including a plurality of air knives directed toward the glass workpieces, wherein air is supplied to specific air knives substantially along the length of the air knives;

a blower; and a concentric air hose connecting said blower to said plurality of air knives.

9. The glass washing machine of claim 8 wherein a blower is positioned in an enclosed space spaced from said drying section.

10. The glass washing machine of claim 9 wherein said blower is mounted in said enclosed space with vibration damping mounting.

11. The glass washing machine of claim 10 further including sound reducing panels substantially completely surrounding said drying section.

12. The glass washing machine of claim 11 wherein said panels include lateral labyrinth type vents.

13. A glass washing machine comprising:

a washing section for cleaning glass workpieces;

a plurality of brushes and pressure sprays positioned in said washing section;

a drying section linearly spaced from said drying section;

a chain-driven conveyor through said washing section and said drying section for conveying glass workpieces therethrough;

sound reducing panels substantially completely surrounding said washing section and said drying section;

a blower in an enclosed space spaced from said washing section and said drying section, said blower including vibration damping mounting for a motor of said blower; and a plurality of air knives in said drying section, and a concentric hose transporting air from the blower to each individual air knife wherein the air is supplied along the length of the air knives.

* * * * *